US007942698B2

(12) United States Patent
Nanao et al.

(10) Patent No.: US 7,942,698 B2
(45) Date of Patent: May 17, 2011

(54) CONNECTOR HAVING CONTACTS WITH A LINKAGE PORTION HAVING A WIDTH SMALLER THAN THAT OF THE CONTACT PORTION

(75) Inventors: Shingo Nanao, Tokyo (JP); Yasufumi Yahiro, Tokyo (JP); Masayuki Kikuchi, Tokyo (JP); Keizo Kai, Tokyo (JP); Kazushi Kamata, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/843,164

(22) Filed: Jul. 26, 2010

(65) Prior Publication Data

US 2011/0086553 A1 Apr. 14, 2011

(30) Foreign Application Priority Data

Oct. 8, 2009 (JP) ..... 2009-234447

(51) Int. Cl.
*H01R 13/648* (2006.01)

(52) U.S. Cl. ..... 439/607.31

(58) Field of Classification Search ..... 439/607.31–607.35, 79, 95, 328, 439/147

See application file for complete search history.

(56) References Cited

U.S. PATENT DOCUMENTS

| | | | | |
|---|---|---|---|---|
| 5,921,814 | A * | 7/1999 | Maruyama | 439/607.35 |
| 7,134,912 | B2 * | 11/2006 | Kamata et al. | 439/607.31 |
| 7,661,988 | B1 * | 2/2010 | He et al. | 439/607.32 |
| 7,699,655 | B2 * | 4/2010 | Wang et al. | 439/607.33 |
| D628,160 | S * | 11/2010 | Nanao et al. | D13/147 |
| 2002/0072264 | A1 * | 6/2002 | Yahiro et al. | 439/328 |
| 2005/0260871 | A1 * | 11/2005 | Kamata et al. | 439/79 |

FOREIGN PATENT DOCUMENTS

JP 2008-293916 A 12/2008

* cited by examiner

*Primary Examiner* — Chandrika Prasad
(74) *Attorney, Agent, or Firm* — Holtz, Holtz, Goodman & Chick, PC

(57) ABSTRACT

A connector capable of maintaining contact reliability even with reduced arrangement pitch of contacts. First and second contacts are alternately arranged on a housing along contact arrangement direction orthogonal to direction of fitting the housing to a receptacle connector. A first contact portion, first bending portion, and first connecting portion connected to a coaxial cable, of each first contact are disposed on an upper surface, front portion and rear portion of the arranging portion, respectively. A linkage portion connecting the first bending and connecting portions, and a second contact portion continuous with a second connecting portion of each second contact are disposed on a lower surface of the arranging portion. A second bending portion disposed on the front portion is continuous with the second contact portion. The linkage portion is smaller in width in the arrangement direction than the first and second contact portions.

9 Claims, 21 Drawing Sheets

CONNECTOR HAVING CONTACTS WITH A LINKAGE PORTION HAVING A WIDTH SMALLER THAN THAT OF THE CONTACT PORTION

BACKGROUND OF THE INVENTION

1. Field of the Invention

This invention relates to a connector.

2. Description of the Related Art

Conventionally, there has been proposed a plug connector comprised of a housing and a plurality of signal contacts (see Japanese Laid-Open Patent Publication (Kokai) No. 2008-293916 (paragraphs 0027 to 0029, 0032, and 0033; FIG. 1)).

The housing has a plate-shaped projecting portion in which are arranged first and second contact portions, referred to hereinafter, of the signal contacts.

The signal contacts are held on the housing at a predetermined pitch along a contact arrangement direction which is orthogonal to a direction of fitting the housing to a mating connector. Each signal contact has a first contact portion and a second contact portion. The first contact portion is disposed on an upper surface of the projecting portion of the housing. The second contact portion, which is continuous with the first contact portion, is bent into a U-shape such that it extends along an arc-shaped front end surface of the projecting portion of the housing, and reaches a lower surface of the projecting portion.

A receptacle connector as the mating connector of the plug connector is comprised of a housing and a plurality of signal contacts.

The housing of the receptacle connector receives therein the projecting portion of the housing of the plug connector.

Each signal contact of the receptacle connector is bifurcated, and has a first contact portion and a second contact portion. The first contact portion and the second contact portion are displaced in the fitting direction.

When the plug connector and the receptacle connector are fitted to each other, the first and second contact portions of each signal contact of the plug connector are brought into contact with the first and second contact portions of each signal contact of the receptacle connector, respectively.

To reduce the arrangement pitch of the signal contacts of the above-mentioned plug and receptacle connectors, it is only required to reduce the width of each of the first and second contact portions of the plug and receptacle connectors in the contact arrangement direction.

However, if the width of each of the first and second contact portions in the contact arrangement direction is reduced in order to reduce the arrangement pitch of the signal contacts, misalignment of the first and second contact portions of the plug connector and the first and second contact portions of the receptacle connector, which can be caused e.g. by loose or inaccurate fitting, reduces areas of contact between the first and second contact portions of the receptacle connector and the associated first and second contact portions of the plug connector. In such a case, there is a fear of occurrence of contact failure.

SUMMARY OF THE INVENTION

The present invention has been made in view of these circumstances, and an object thereof is to provide a connector which is capable of maintaining contact reliability even if the arrangement pitch of contacts is reduced.

To attain the above object, the present invention provides a connector comprising a housing that includes a contact arranging portion which is plate-shaped, and first and second contacts that are arranged on the housing in an alternating manner along a contact arrangement direction which is orthogonal to a direction of fitting the housing to a mating connector, the first contacts each having a first contact portion which is disposed on one surface of the contact arranging portion, a first bending portion which is continuous with the first contact portion, and is disposed on a front portion of the contact arranging portion, a first connecting portion which is disposed on a rear portion of the contact arranging portion, and is connected to an object to be connected, and a linkage portion which is disposed on the other surface of the contact arranging portion, and connects between the first bending portion and the first connecting portion, the second contacts each having a second connecting portion which is connected to the object to be connected, a second contact portion which is continuous with the second connecting portion, and is disposed on the other surface of the contact arranging portion, and a second bending portion which is continuous with the second contact portion, and is disposed on the front portion of the contact arranging portion, wherein the linkage portion is smaller in width in the contact arrangement direction than the first contact portion and the second contact portion.

With the arrangement of the connector according to the present invention, the first contact portions are disposed on one surface of the contact arranging portion, and the second contact portions and the linkage portions are disposed on the other surface of the contact arranging portion. Further, each linkage portion is made smaller in width in the contact arrangement direction than the first and second contact portions. Therefore, it is possible to reduce the arrangement pitch of the first and second contact portions without reducing the width of the first and second contact portions in the contact arrangement direction.

Preferably, the second contacts each have an extension portion which is continuous with the second bending portion, and is disposed on the one surface of the contact arranging portion, and the extension portion is smaller in width in the contact arrangement direction than the first contact portion and the second contact portion.

Preferably, a width of the first contact portion in the contact arrangement direction is equal to a width of the second contact portion in the contact arrangement direction.

More preferably, a width of the linkage portion in the contact arrangement direction is equal to a width of the extension portion in the contact arrangement direction.

More preferably, a width of the first bending portion in the contact arrangement direction is gradually reduced from the first contact portion toward the linkage portion, with a width of one end of the first bending portion in the contact arrangement direction being equal to a width of the first contact portion, and a width of the other end of the first bending portion in the contact arrangement direction being equal to a width of the linkage portion, and a width of the second bending portion in the contact arrangement direction is gradually reduced from the second contact portion toward the extension portion, with a width of one end of the second bending portion in the contact arrangement direction being equal to a width of the second contact portion, and a width of the other end of the second bending portion in the contact arrangement direction being equal to a width of the extension portion.

According to this invention, even if the arrangement pitch of the contacts is reduced, it is possible to maintain contact reliability.

The above and other objects, features and advantages of the present invention will become more apparent from the following detailed description taken in conjunction with the accompanying drawings.

DETAILED DESCRIPTION OF THE PREFERRED EMBODIMENTS

Figure 1:
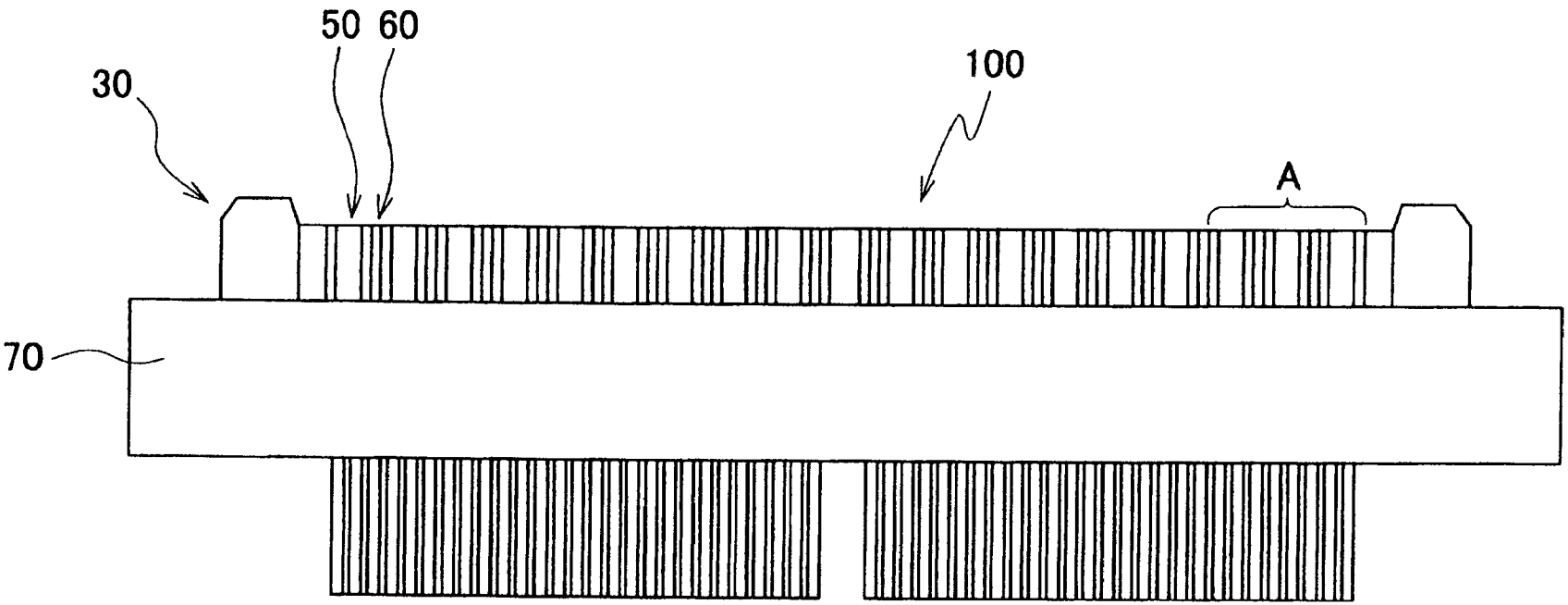
FIG. 1 is a plan view of a plug connector according to an embodiment of the present invention.

The present invention will now be described in detail with reference to the drawings showing preferred embodiments thereof. A description will be given of a plug connector of an embodiment of the present invention with reference to FIGS. 1 to 20.

As shown in FIGS. 1 to 4, a plug connector (connector) 100 is comprised of a housing 30, a plurality of first contacts 50, a plurality of second contacts 60, a cover shell 70, and a base shell 80.

Figure 4:
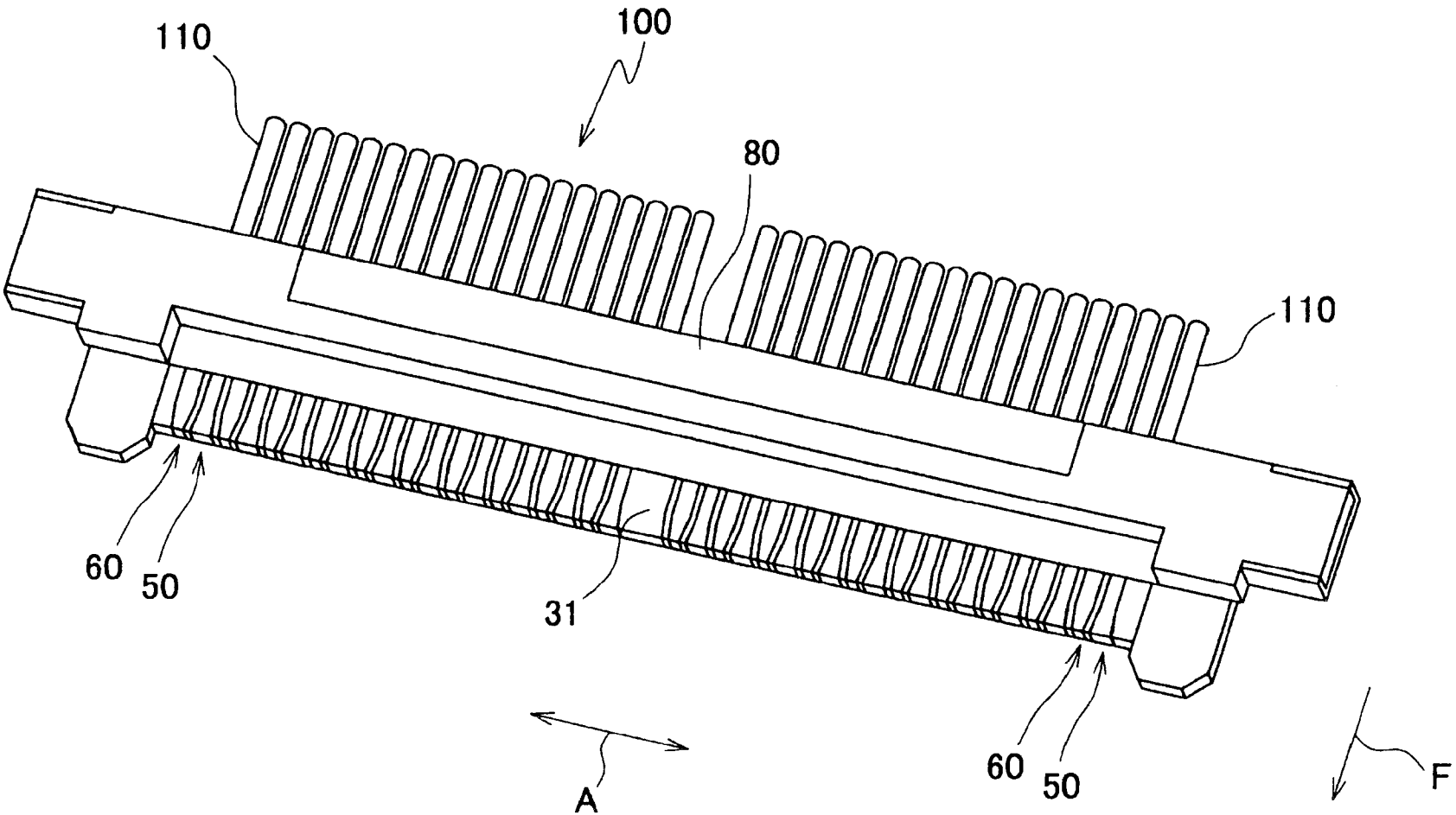
FIG. 4 is a perspective view of the plug connector shown in FIG. 2 in a state in which the plug connector is inverted upside down.
Figure 5:
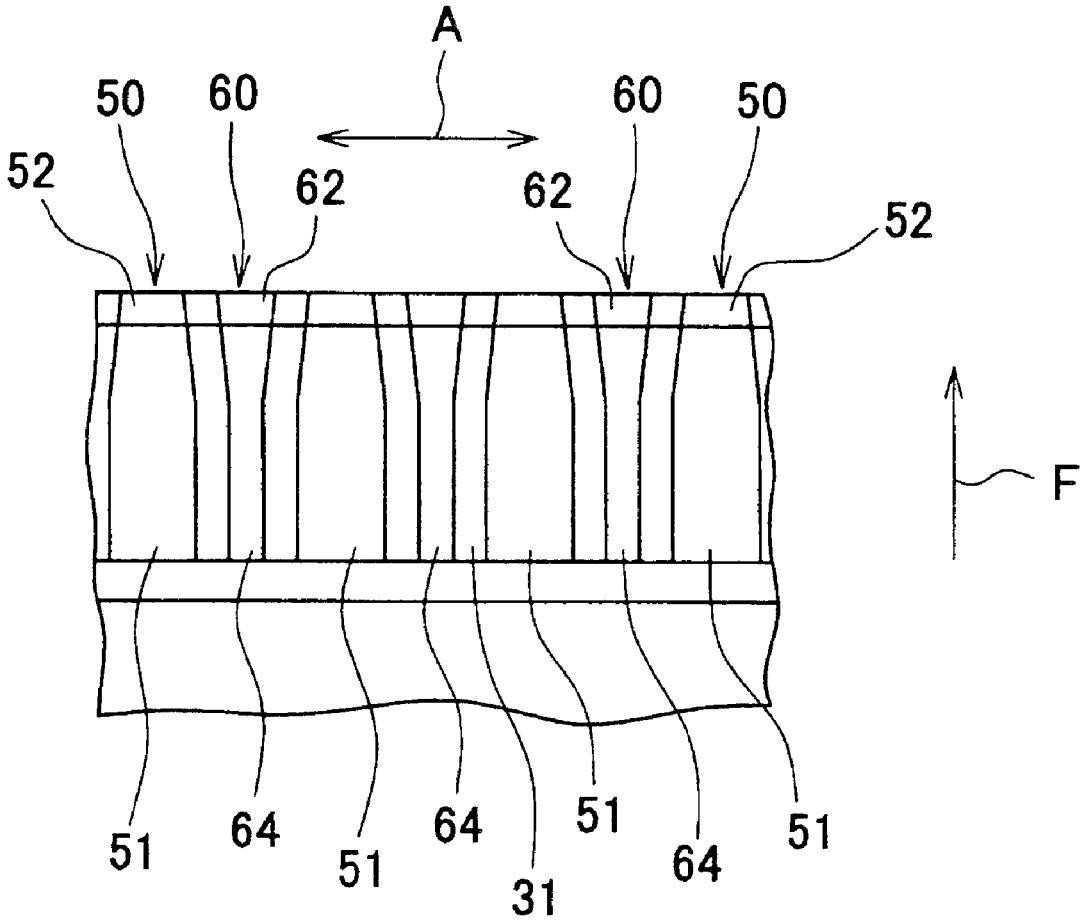
FIG. 5 is a partial enlarged view of FIG. 1.
Figure 6:
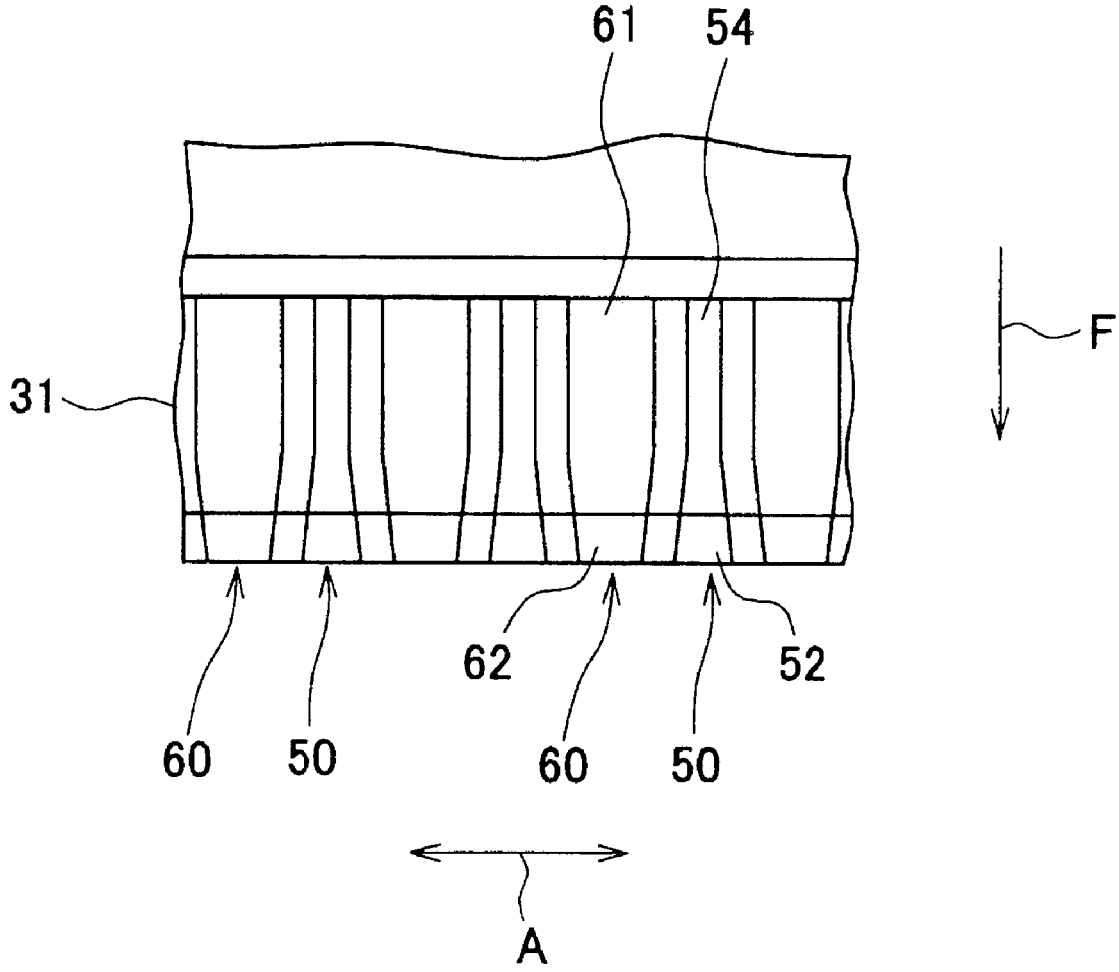
FIG. 6 is a partial enlarged view of FIG. 3.

As shown in FIGS. 1 and 4, the first contacts 50 and the second contacts 60 are arranged in the housing 30 in an alternating manner in a contact arrangement direction A.

Figure 7:
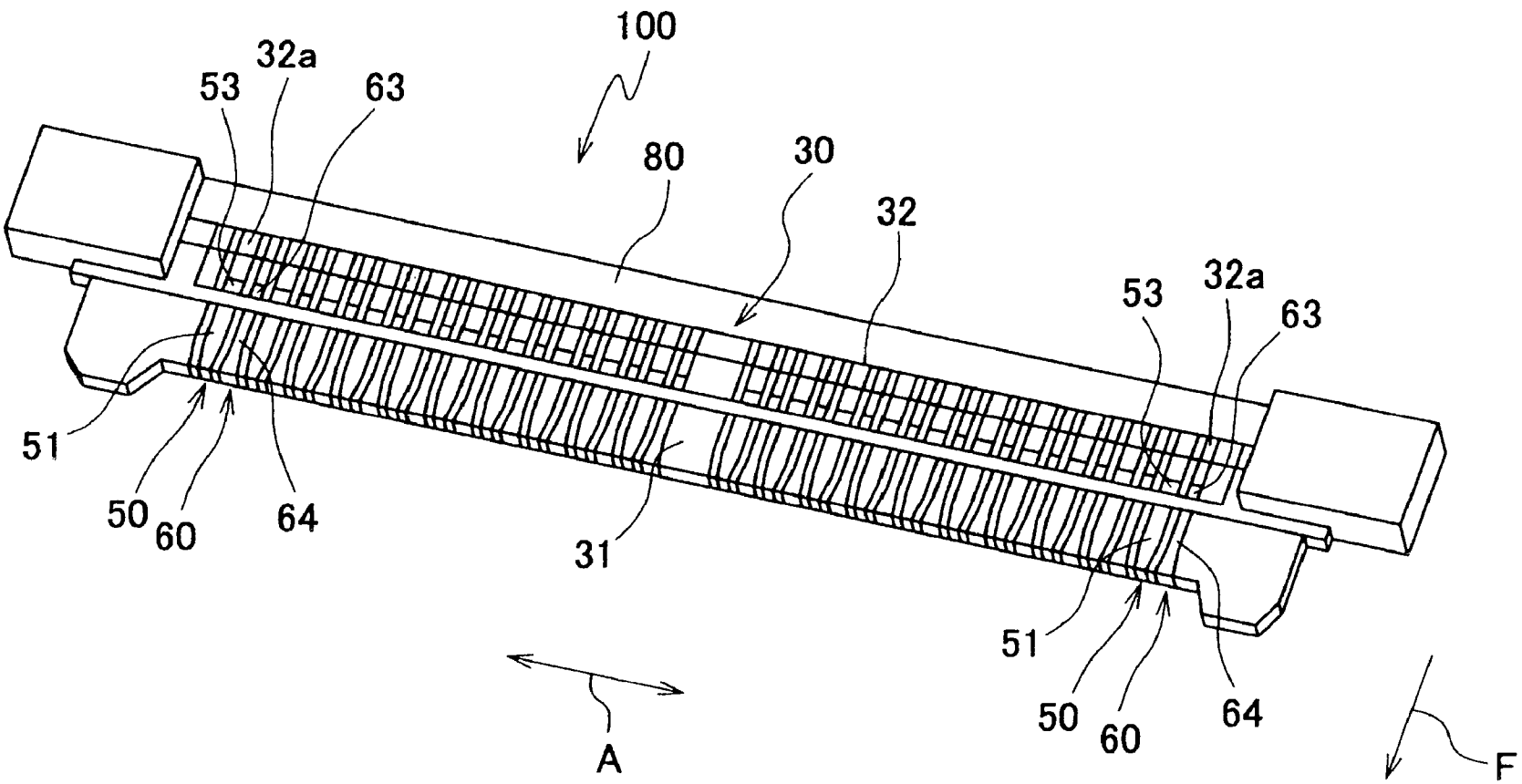
FIG. 7 is a perspective view of the plug connector shown in FIG. 1 in a state in which a cover shell and cables are removed from the plug connector.
Figure 8:
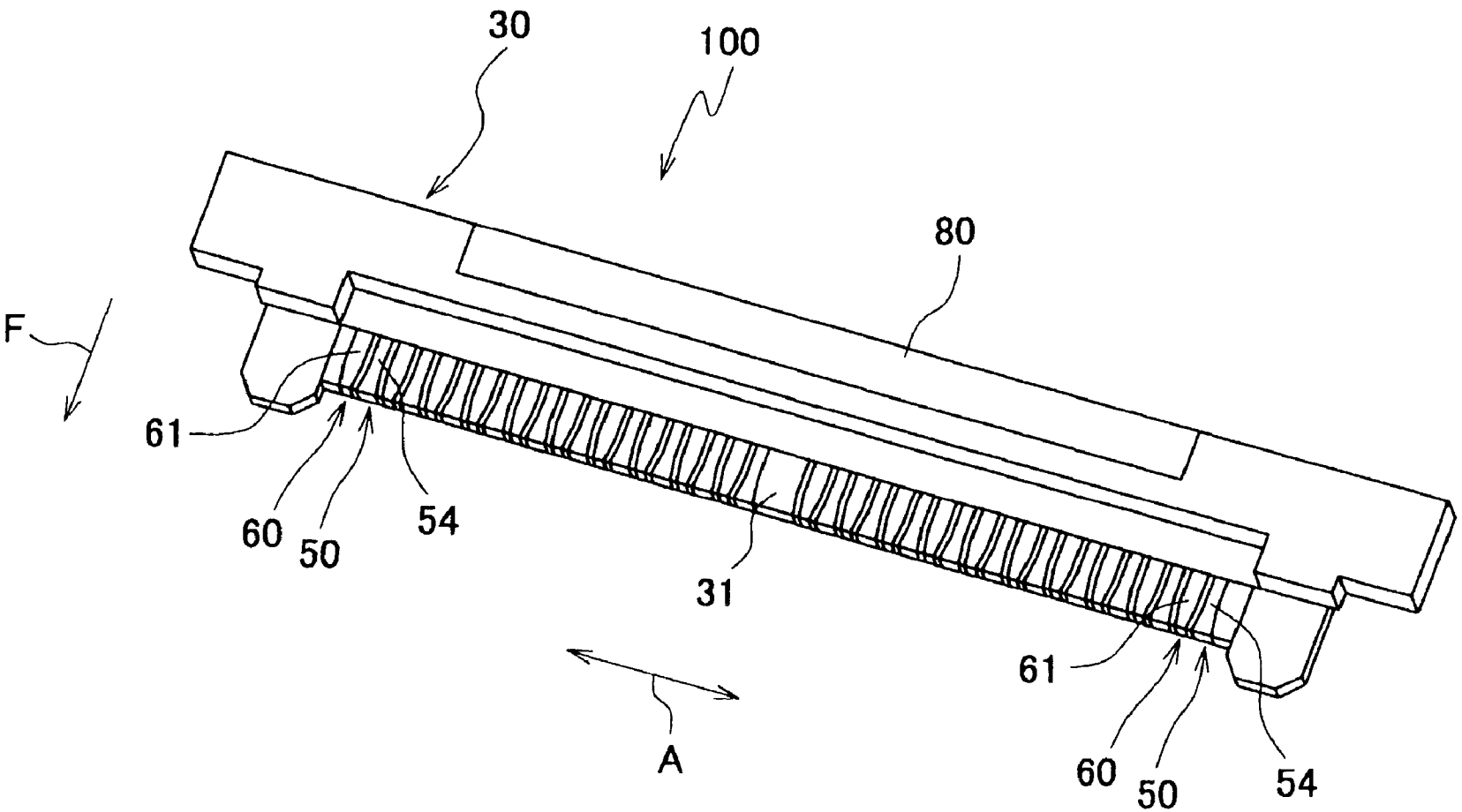
FIG. 8 is a perspective view of the plug connector shown in FIG. 7 in a state in which the plug connector is inverted upside down.

The housing 30 is integrally molded of an insulating material. As shown in FIGS. 7 and 8, a contact arranging portion 31 is disposed on a front portion of the housing 30, and a cable holding portion 32 is disposed on a rear portion of the housing 30. In the present embodiment, the front portion of the housing 30 corresponds to a lower portion as viewed in FIGS. 7 and 8, and the rear portion of the housing 30 corresponds to an upper portion as viewed in FIGS. 7 and 8. Further, the upper surface of the housing 30 is shown in FIG. 7, and the lower surface of the housing 30 is shown in FIG. 8.

The contact arranging portion 31 is substantially plate-shaped. The contact arranging portion 31 extends in the contact arrangement direction A which is orthogonal to a fitting direction F of the housing 30. First contact portions 51 of the first contacts 50 and extension portions 64 of the second contacts 60, referred to hereinafter, are arranged on the upper surface of the contact arranging portion 31 in an alternating manner at predetermined space intervals along the contact arrangement direction A (see FIG. 5). Linkage portions 54 of the first contacts 50 and second contact portions 61 of the second contacts 60, referred to hereinafter, are arranged on the lower surface of the contact arranging portion 31 in an alternating manner at predetermined space intervals along the contact arrangement direction A (see FIG. 6).

As shown in FIG. 7, the cable holding portion 32 is continuous with the contact arranging portion 31, and extends in the contact arrangement direction A. The cable holding portion 32 is formed with a plurality of cable holding grooves 32*a* at predetermined space intervals along the contact arrangement direction A.

Figure 9:
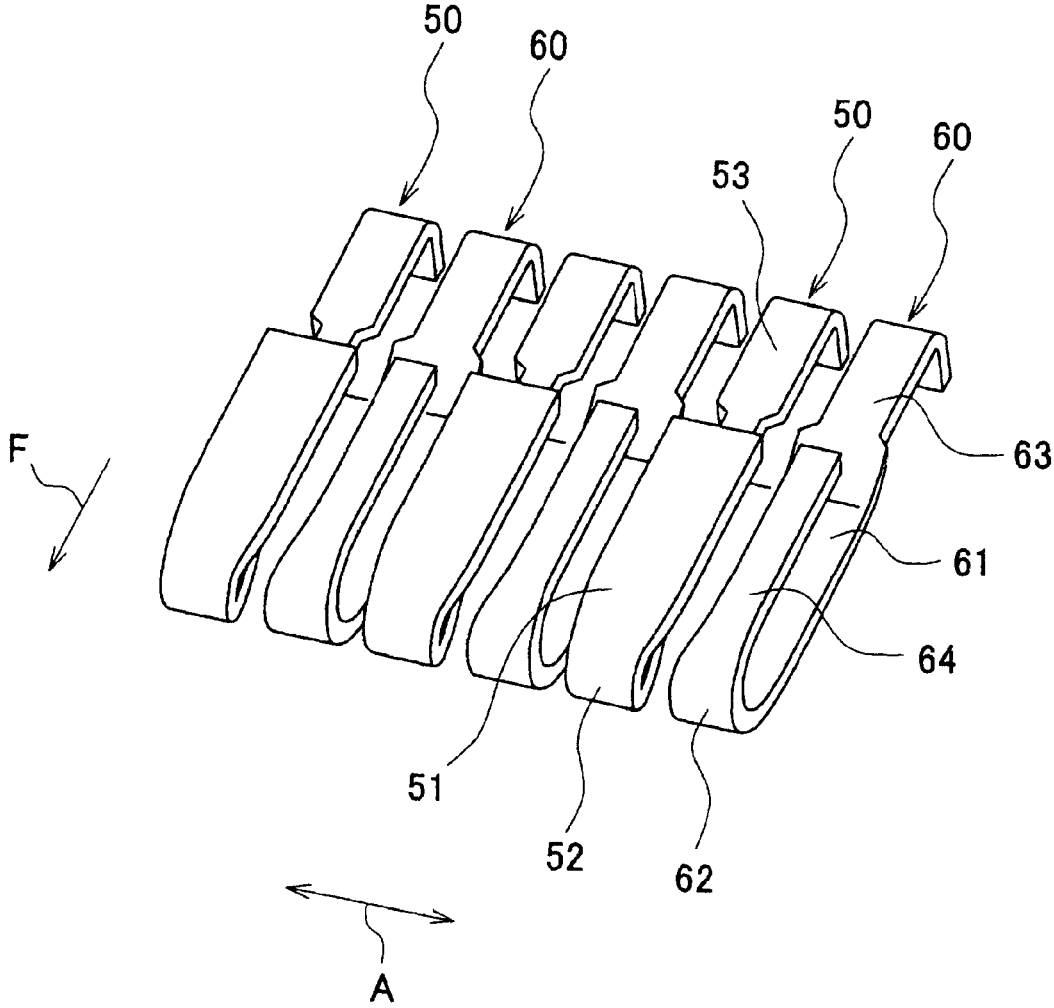
FIG. 9 is a perspective view of first and second contacts of the plug connector as viewed obliquely from above.
Figure 10:
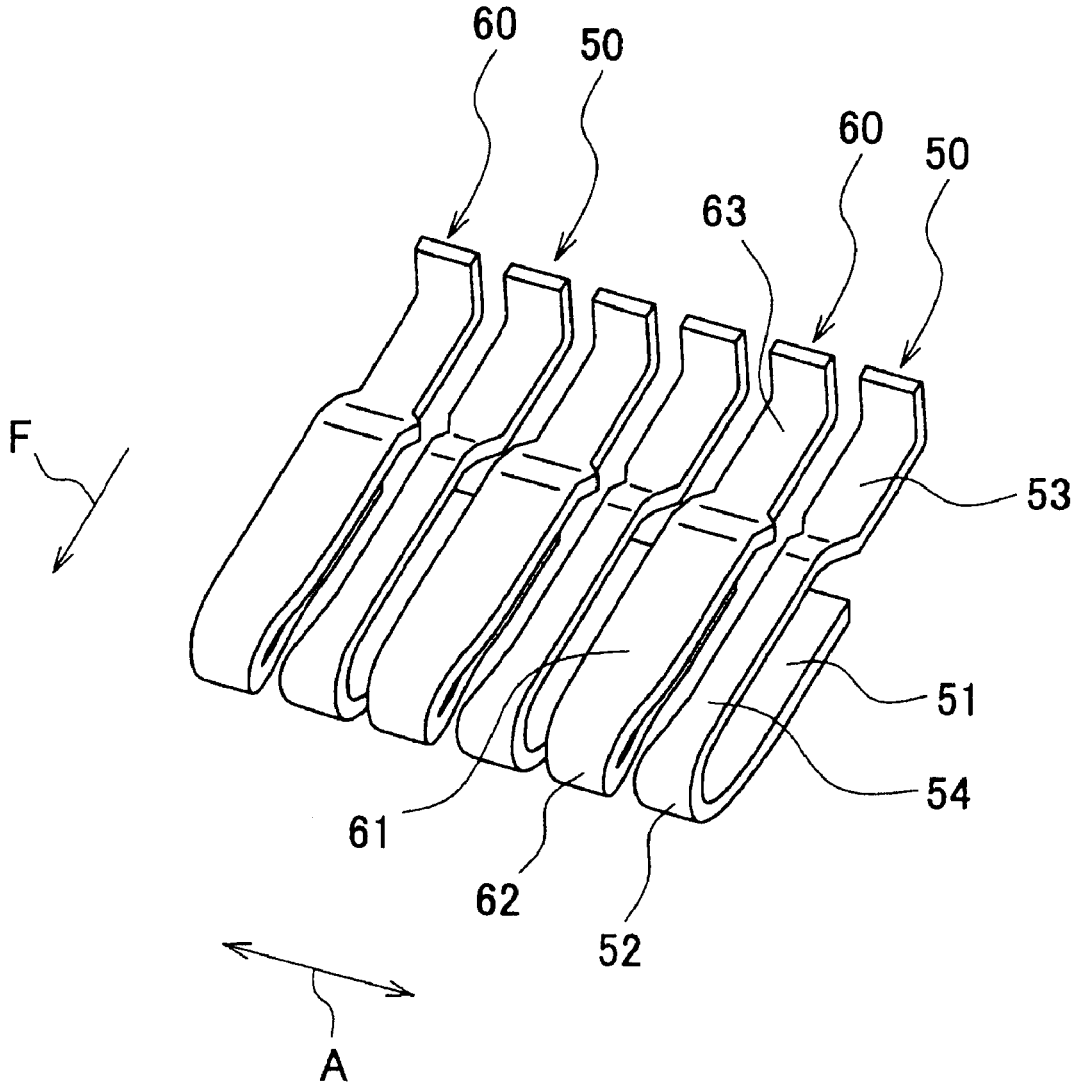
FIG. 10 is a perspective view of the first and second contacts of the plug connector shown in FIG. 9 in a state in which the first and second contacts are inverted upside down.

As shown in FIGS. 9 and 10, the first contacts 50 each include the first contact portion 51, a first bending portion 52, a first connecting portion 53, and the linkage portion 54. Each first contact 50 is formed by blanking and bending a metal plate, similarly to each of the second contacts 60 and the base shell 80, referred to hereinafter.

The first contact portion 51 is substantially plate-shaped, and is disposed on the upper surface of the contact arranging portion 31 such that it extends in the fitting direction F. The first bending portion 52 is continuous with the first contact portion 51. The first bending portion 52 is bent into a substantially arc shape such that it is fitted to the substantially arc-shaped front portion of the contact arranging portion 31. The first connection porting 53 is at a location rearward of the contact arranging portion 31, and is disposed on the cable holding portion 32 (see FIGS. 7 and 18). The linkage portion 54 is substantially plate-shaped, and is disposed on the lower surface of the contact arranging portion 31 such that it extends in the fitting direction F. The linkage portion 54 connects between the first bending portion 52 and the first connecting portion 53.

As shown in FIGS. 9 and 10, the second contacts 60 each include the second contact portion 61, a second bending portion 62, a second connecting portion 63, and the extension portion 64.

The second contact portion 61 is substantially plate-shaped, and is disposed on the lower surface of the contact arranging portion 31 such that it extends in the fitting direction F. The second bending portion 62 is continuous with the second contact portion 61. The second bending portion 62 is bent into a substantially arc shape such that it is fitted to the substantially arc-shaped front portion of the contact arranging portion 31. The second connecting portion 63, which is continuous with the second contact portion 61, is at a location rearward of the contact arranging portion 31, and is disposed on the cable holding portion 32 (see FIG. 7). The extension portion 64 is substantially plate-shaped, and is disposed on the upper surface of the contact arranging portion 31 such that it extends in the fitting direction F. The extension portion 64 is continuous with the second bending portion 62.

The width of the second contact portion 61 of each second contact 60 in the contact arrangement direction A is equal to that of the first contact portion 51 of each first contact 50 in the contact arrangement direction A.

The width of the extension portion 64 of each second contact 60 in the contact arrangement direction A is equal to that of the linkage portion 54 of each first contact 50 in the contact arrangement direction A.

The width of the linkage portion 54 and that of the extension portion 64 in the contact arrangement direction A are smaller than that of the first contact portion 51 in the contact arrangement direction A.

Figure 15:
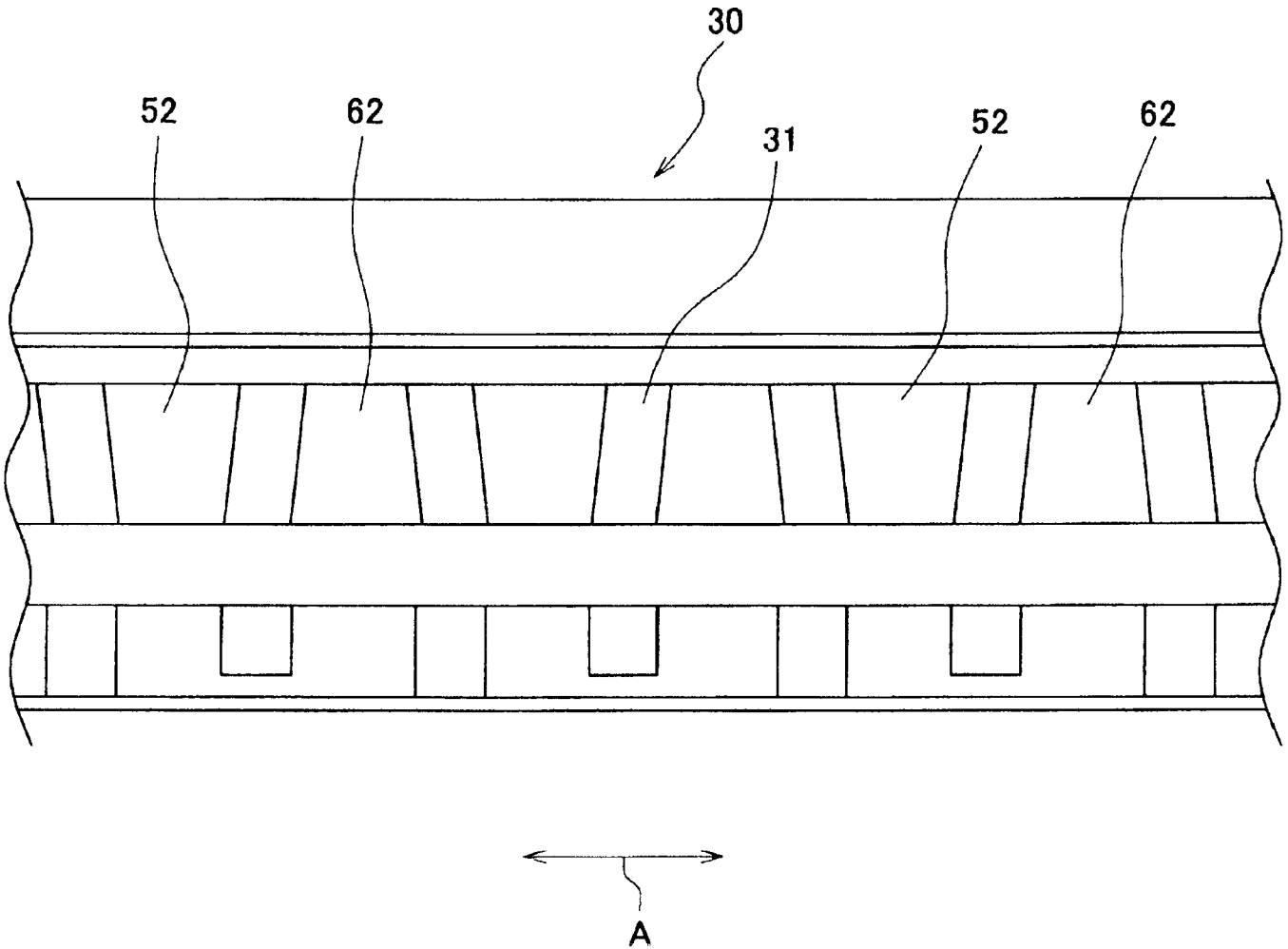
FIG. 15 is a partial enlarged front view of the plug connector shown in FIG. 1.
Figure 16:
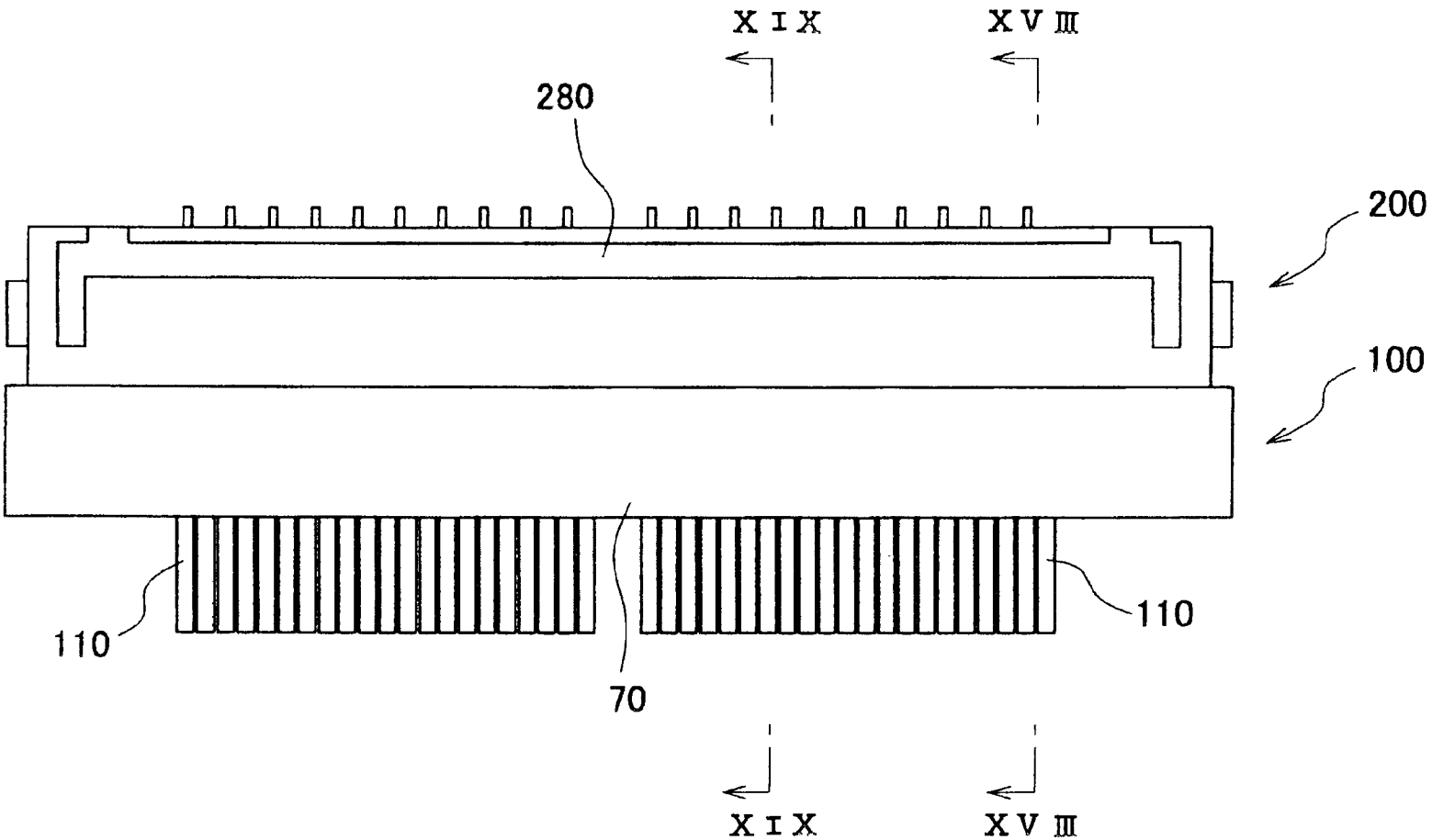
FIG. 16 is a plan view of the plug connector shown in FIG. 1 and the receptacle connector shown in FIG. 11 in a state in which the plug connector and the receptacle connector are fitted to each other.

As shown in FIGS. 9, 10, and 15, the width of one end (toward the first contact portion 51) of the first bending portion 52 of each first contact 50 in the contact arrangement direction A is equal to that of the first contact portion 51 in the contact arrangement direction A, and the width A of the other end (toward the linkage portion 54) of the first bending portion 52 of the first contact 50 in the contact arrangement direction A is equal to that of the linkage portion 54 in the contact arrangement direction A. Further, the width of the first bending portion 52 in the contact arrangement direction A is gradually reduced from one end to the other end of the first bending portion 52.

As shown in FIGS. 9, 10, and 15, the width of one end (toward the second contact portion 61) of the second bending portion 62 of each second contact 60 in the contact arrangement direction A is equal to that of the second contact portion 61 in the contact arrangement direction A, and the width of the other end (toward the extension portion 64) of the second bending portion 62 of the second contact 60 in the contact arrangement direction A is equal to that of the extension portion 64 in the contact arrangement direction A. Further, the width of the second bending portion 62 in the contact arrangement direction A is gradually reduced from one end to the other end of the second bending portion 62.

Figure 2:
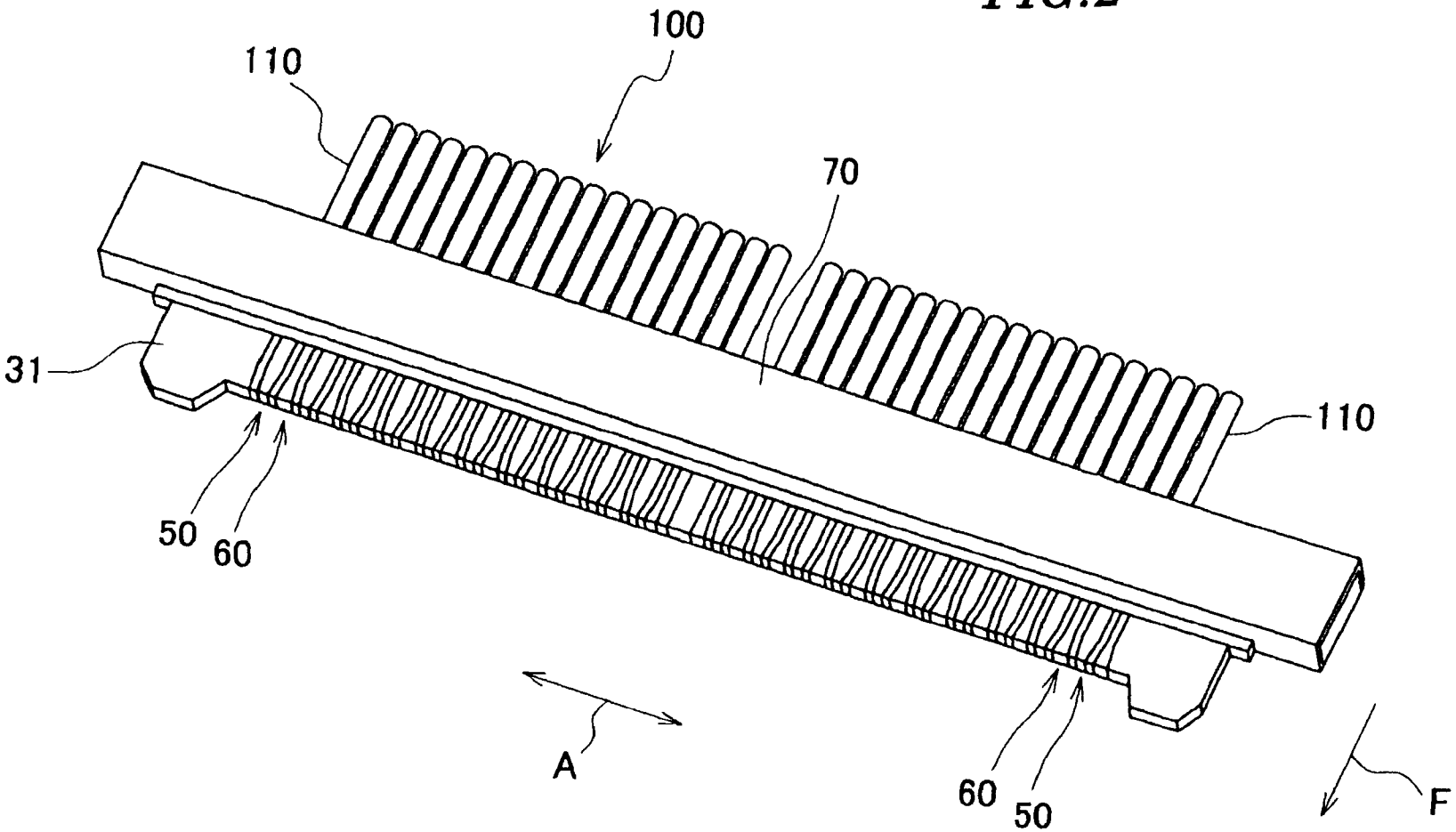
FIG. 2 is a perspective view of the plug connector shown in FIG. 1.

The cover shell 70 appearing in FIGS. 1 and 2 is formed by blanking and bending a metal plate. The cover shell 70 covers the rear portion of the housing 30.

Figure 3:
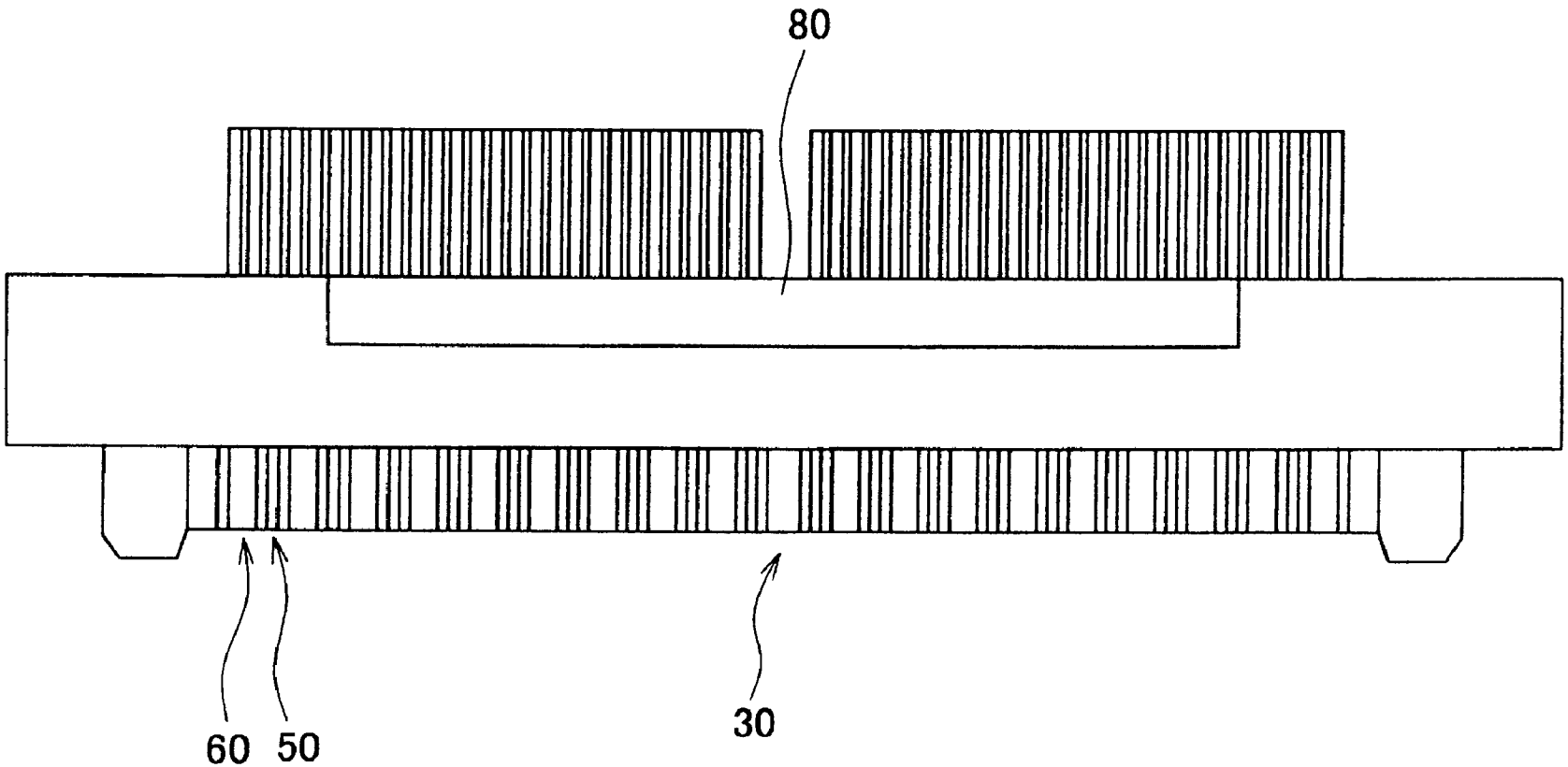
FIG. 3 is a bottom view of the plug connector shown in FIG. 1.

The base shell 80 appearing in FIGS. 3 and 4 is formed by blanking and bending a metal plate. The base shell 80 is disposed on the rear portion of the housing 30.

Next, a brief description will be given of a process for producing the plug connector 100. First, the first contacts 50, the second contacts 60, and the base shell 80 are formed by blanking and bending a metal plate (not shown). At this time, all of the first and second contacts 50 and 60, and the base shell 80 are connected to a carrier (not shown). Further, the cover shell 70 is formed by blanking and bending another metal plate (not shown).

Next, the first contacts 50, the second contacts 60, and the base shell 80, which are connected into one piece by the carrier, are put in a mold (not shown), and the mold is filled with molten resin. Thus, the housing 30 in which the first contacts 50, the second contacts 60, and the base shell 80 are partially embedded is formed by the so-called mold-in molding method (in-mold molding method).

Finally, the cover shell 70 is mounted on the housing 30. Upon going through the above-described process, the production of the plug connector 100 is completed.

Figure 17:
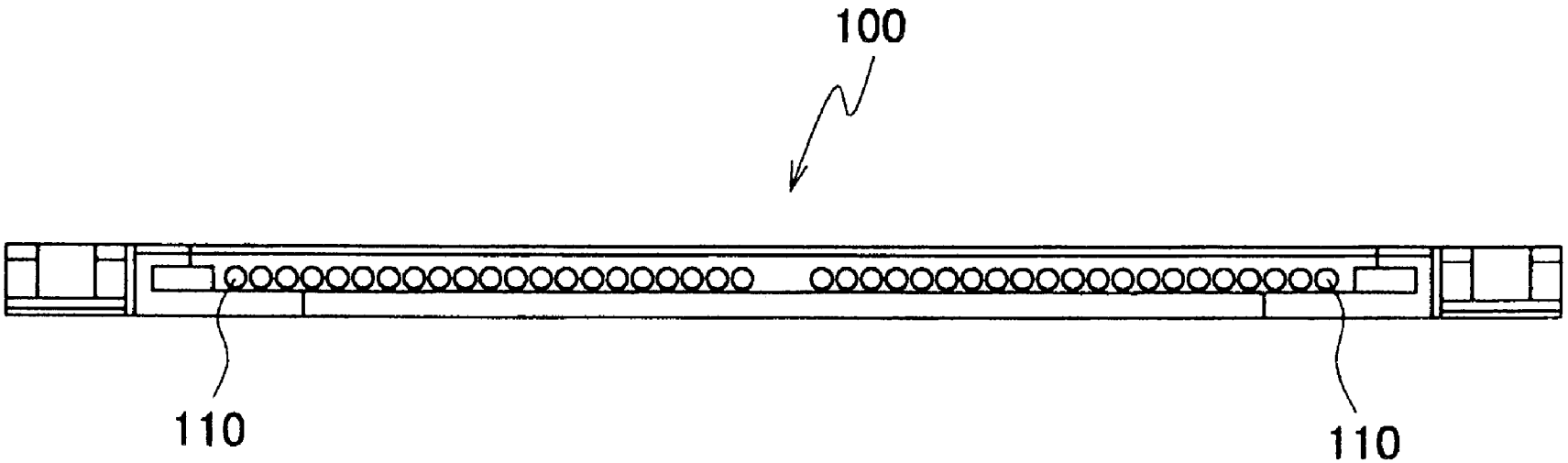
FIG. 17 is a rear view of the plug connector shown in FIG. 1.
Figure 18:
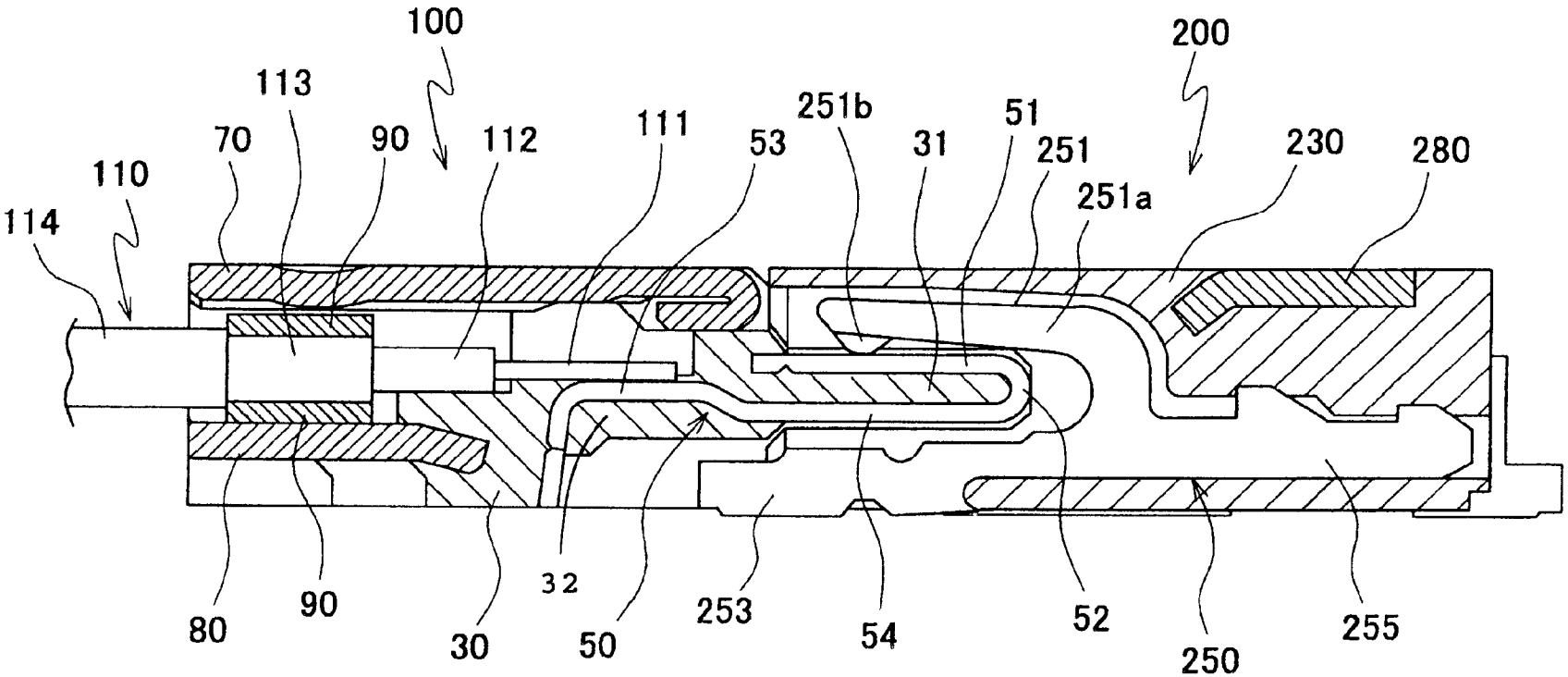
FIG. 18 is a cross-sectional view taken along line XVIII-XVIII of FIG. 16.
Figure 19:
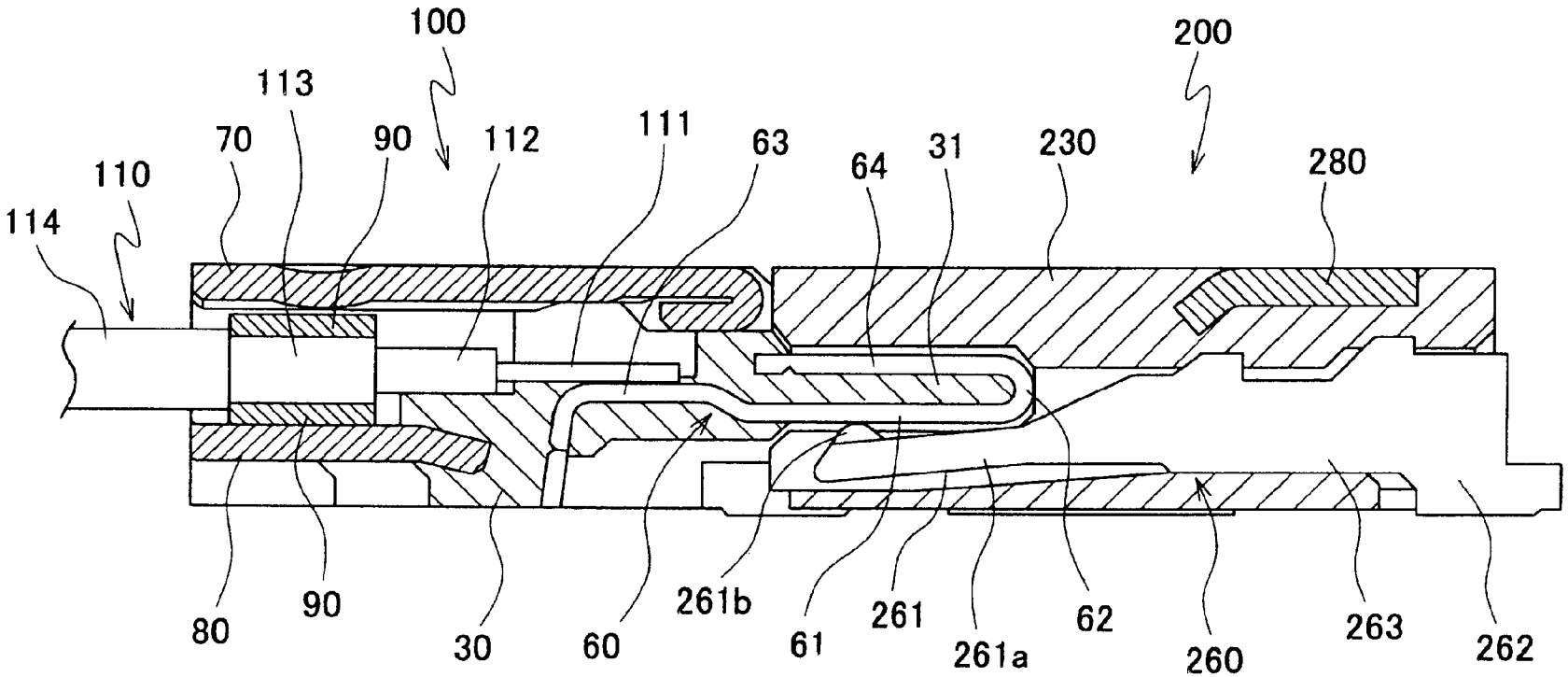
FIG. 19 is a cross-sectional view taken on line XIX-XIX of FIG. 16.
Figure 20:
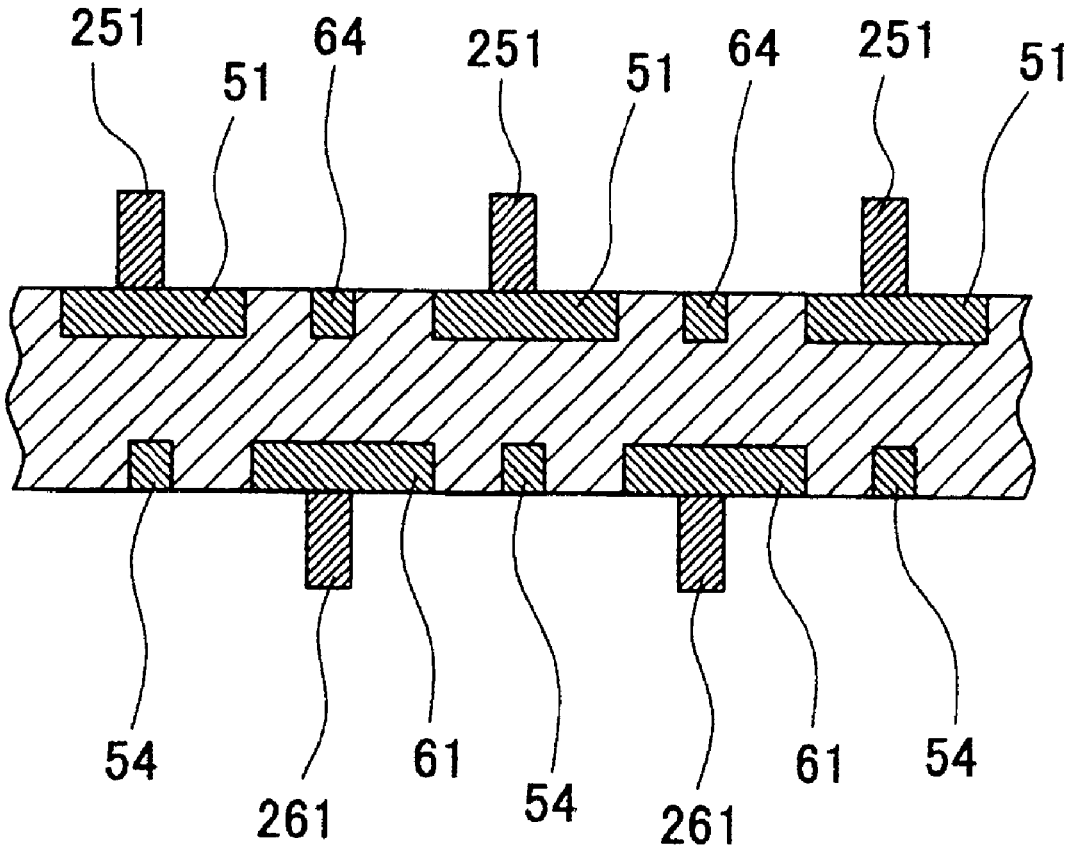
FIG. 20 is a schematic view of a state in which the first and second contacts of the plug connector shown in FIG. 16 are in contact with the first and second contacts of the receptacle connector.

As shown in FIGS. 17, 18, and 19, a plurality of coaxial cables 110 are connected to the plug connector 100. To connect the coaxial cables 110 to the plug connector 100, first, a center conductor 111 is exposed by stripping off an insulator 112 of each coaxial cable 110, and an outer conductor 113 is exposed by stripping off a sheath 114.

Next, the outer conductors 113 of the coaxial cables 110 are sandwiched by two ground bars 90, and are soldered to the ground bars 90.

Thereafter, the ground bars 90 to which the outer conductors 113 are soldered are disposed on the rear portion of the housing 30 of the plug connector 100 from which the cover shell 70 is removed.

Next, the center conductors 111 of the coaxial cables 110 are soldered to the first connecting portions 53 of the first contacts 50 and the second connecting portions 63 of the second contacts 60.

Finally, the cover shell 70 is mounted on the housing 30. Upon going through the above-described process, the connection of the coaxial cables 110 to the plug connector 100 is completed.

Next, a description will be given of a receptacle connector 200 as a mating connector of the plug connector 100.

Figure 11:
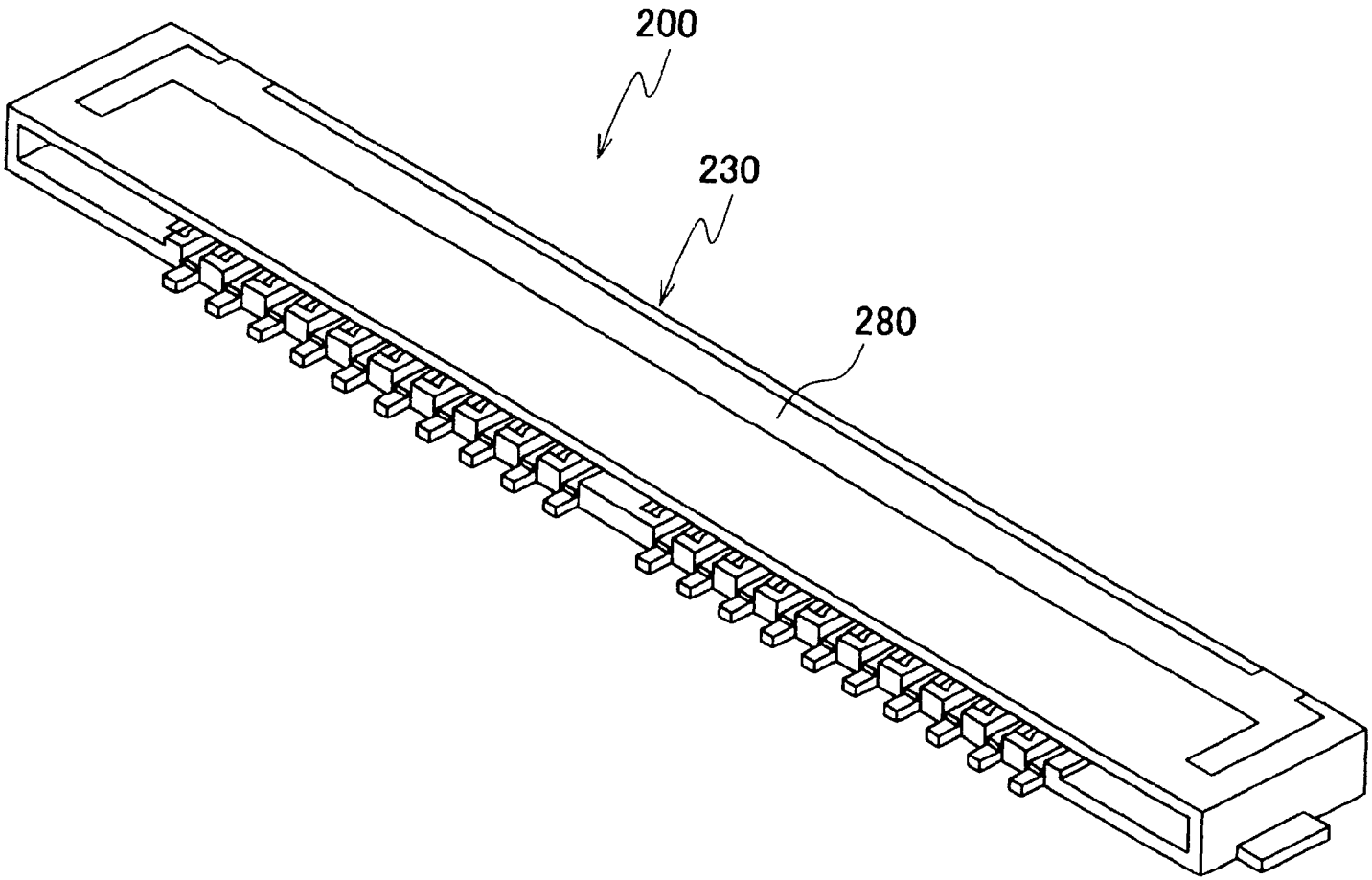
FIG. 11 is a perspective view of a receptacle connector as a mating connector of the plug connector shown in FIG. 1.
Figure 12:
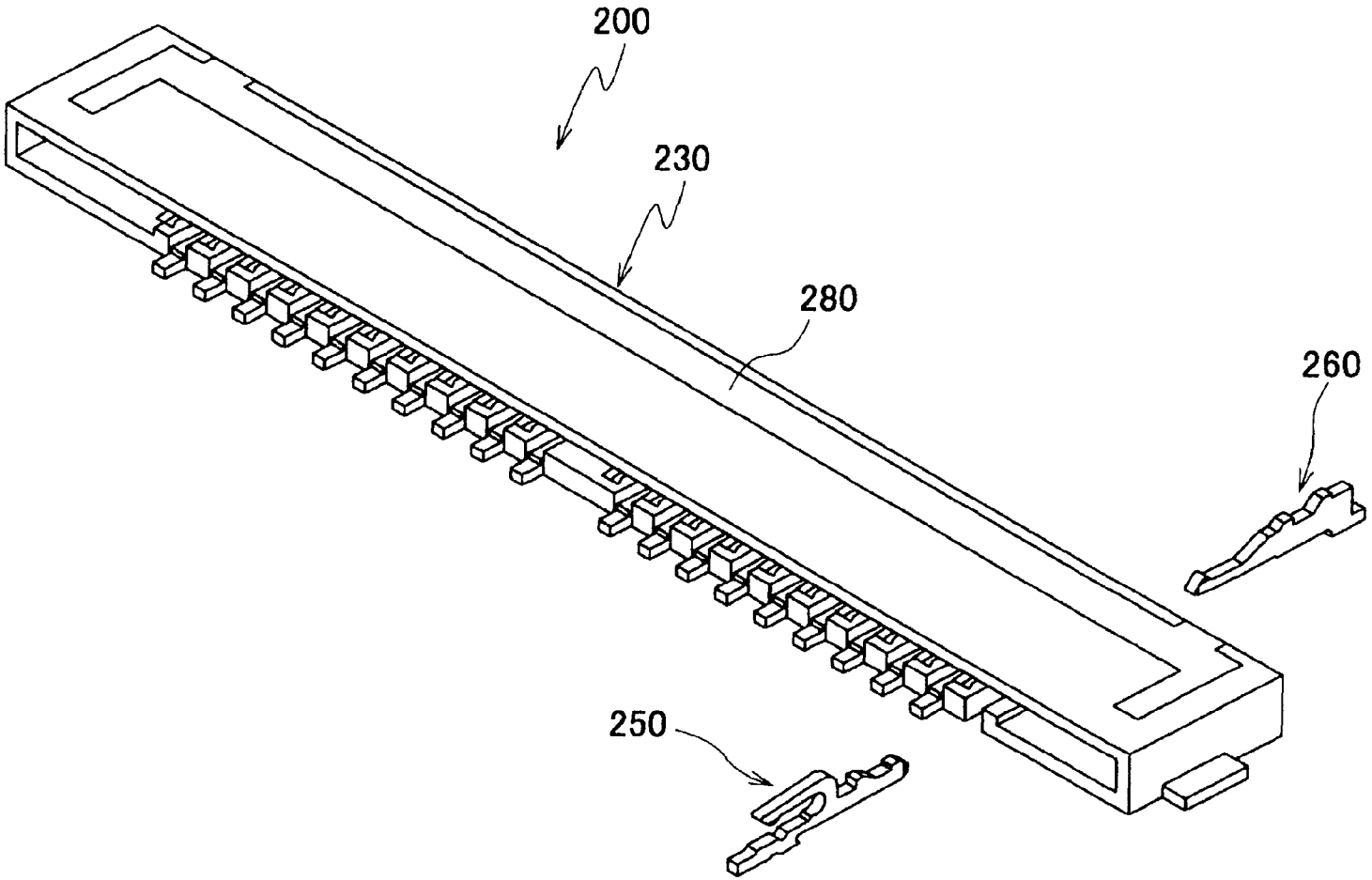
FIG. 12 is a perspective view of the receptacle connector shown in FIG. 11 in a state in which one of the first contacts and one of the second contacts are removed from a housing of the receptacle connector.

As shown in FIGS. 11 and 12, the receptacle connector 200 is comprised of a housing 230, first contacts 250, second contacts 260, and a base shell 280.

The housing 230 is box-shaped, and receives the contact arranging portion 31 of the housing 30 of the plug connector 100.

Figure 13:
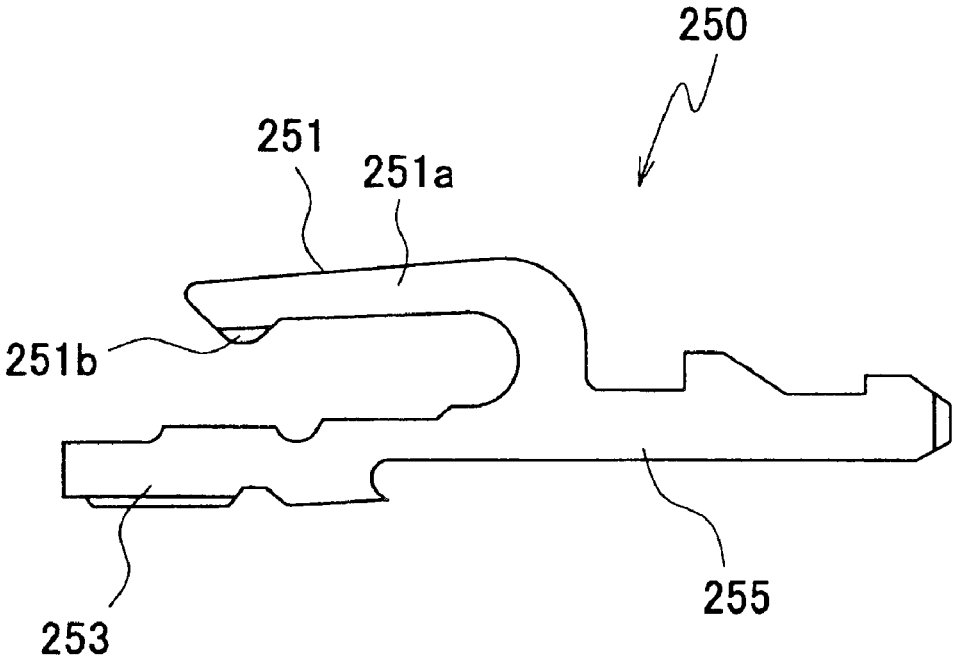
FIG. 13 is a side view of the first contact of the receptacle connector shown in FIG. 12.

As shown in FIG. 13, the first contacts 250 each include a first contact portion 251, a first connecting portion 253, and a first press-fitting portion 255. The first contact portion 251 includes an L-shaped spring portion 251*a* and a contact point 251*b* formed on a front end of the spring portion 251*a*. The first connecting portion 253 is continuous with a rear end portion of the spring portion 251*a* and extends toward the front of the first contact 250. The first press-fitting portion 255 is also continuous with the rear end portion of the spring portion 251*a*, and extends toward the rear of the first contact 250 oppositely to the first connecting portion 253.

Figure 14:
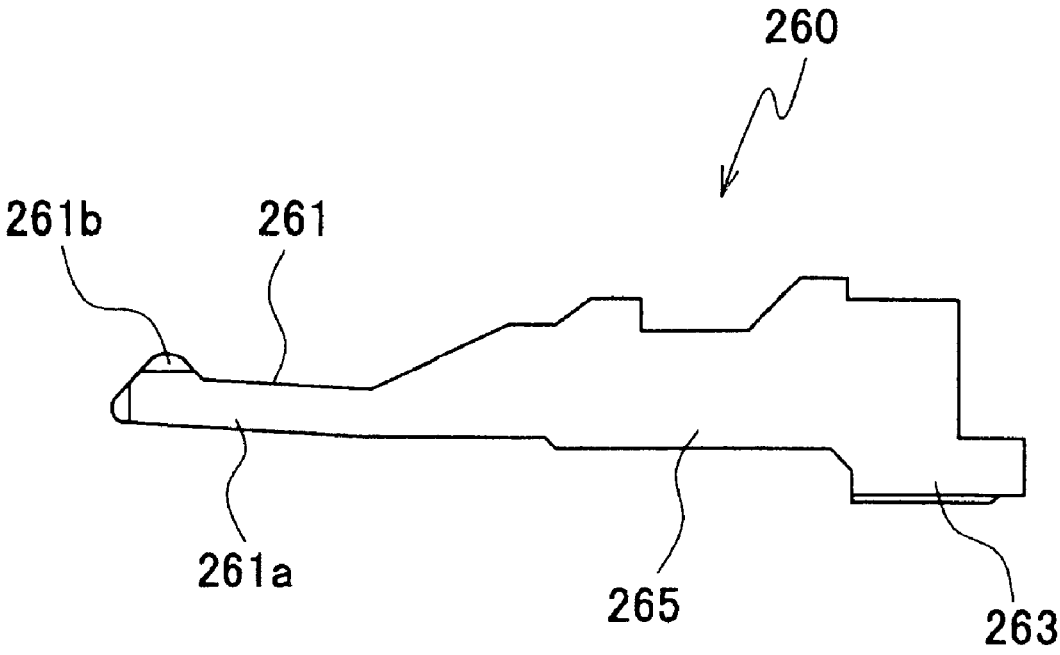
FIG. 14 is a side view of the second contact of the receptacle connector shown in FIG. 12.

As shown in FIG. 14, the second contacts 260 each include a second contact portion 261, a second connecting portion 263, and a second press-fitting portion 265. The second contact portion 261 includes a spring portion 261*a* which linearly extends and a contact point 261*b* formed on a front end of the spring portion 261*a*. The second connecting portion 263 is continuous with a rear end portion of the second press-fitting portion 265. The second press-fitting portion 265 is continuous with a rear end portion of the second contact portion 261.

As shown in FIGS. 11 and 12, part of the base shell 280 is embedded in the housing 230 by the so-called mold-in molding method (in-mold molding method).

The first connecting portions 253 of the first contacts 250 and the second connecting portions 263 of the second contacts 260 of the receptacle connector 200 are soldered to associated pads of a printed circuit board, not shown.

To connect the plug connector 100 to the receptacle connector 200, it is only required, as shown in FIGS. 18 and 19, to insert the contact arranging portion 31 of the housing 30 of the plug connector 100 into the housing 230 of the receptacle connector 200.

As shown in FIGS. 16, 18, 19, and 20, when the plug connector 100 and the receptacle connector 200 are fitted to each other, the first contact portions 51 of the first contacts 50 of the plug connector 100 are brought into contact with the first contact portions 251 of the first contacts 250 of the receptacle connector 200, respectively, and the second contact portions 61 of the second contacts 60 of the plug connector 100 are brought into contact with the second contact portions 261 of the second contacts 260 of the receptacle connector 200, respectively.

In the present embodiment, as described above, the portions other than the first and second connecting portions 53 and 63 of each of the first and second contacts 50 and 60 extend from the lower surface of the contact arranging portion 31, passing on the front portion of the contact arranging portion 31 in a folding back manner, to the upper surface of the contact arranging portion 31. Further, each first contact portion 51 and each extension portion 64 are disposed on the upper surface of the contact arranging portion 31, and each second contact portion 61 and each linkage portion 54 are disposed on the lower surface of the contact arranging portion 31, with the width of the linkage portion 54 and that of the extension portion 64 in the contact arrangement direction A being made smaller than that of the first contact portion 51 and that of the second contact portion 61 in the contact arrangement direction A. This make it possible to reduce the arrangement pitch of the first contact portions 51 and the second contact portions 61 without reducing the width of the first contact portions 51 and that of the second contact portions 61 in the contact arrangement direction A. Therefore, when the plug connector 100 is fitted to the receptacle connector 200, even if the centers of the first and second contact portions 51 and 61 of the plug connector 100 are slightly displaced in the contact arrangement direction A with respect to the centers of the associated first and second contact portions 251 and 261 of the receptacle connector 200, the contact areas between the first and second contact portions 51 and 61, and the first and second contact portions 251 and 261 are not largely reduced, so that the stable contact is ensured.

According to the present embodiment, it is possible to realize the narrower pitch of the first and second contact portions 51 and 61 of the plug connector 100 without lowering the contact reliability between the first and second contact portions 51 and 61 of the plug connector 100, and the first and second contact portions 251 and 261 of the receptacle connector 200.

Further, even if the narrower pitch of the plug connector 100 is realized, the width of each first contact 50 and that of each second contact 60 in the contact arrangement direction A are not reduced, and hence the contact stability is not lowered. Further, it is possible to secure a space between each first contact 50 and each second contact 60, and it is possible to hold the first and second contact portions 51 and 61, the linkage portions 54, and the extension portions 64, by the mold, when molding the housing 30 using the mold, which suppresses falling-down of the first and second contacts 50 and 60 in either of the contact arrangement direction A and the direction (direction of thickness) orthogonal to the contact arrangement direction A, and like inconveniences. Therefore, the posture of each of the first and second contacts 50 and 60 is stabilized, and the accuracy of the arrangement pitch of the first and second contacts 50 and 60 is improved.

Further, the first and second bending portions 52 and 62 are disposed on the front portion of the contact arranging portion 31, and hence when the plug connector 100 is fitted to the receptacle connector 200, the first and second bending portions 52 and 62 are first brought into abutment with the end portions of the first and second contacts 250 and 260 of the receptacle connector 200. Therefore, the contact arranging portion 31 of the housing 30 is less liable to be shaved. Further, each second contact 60 is formed with the extension portion 64, and hence it is possible to positively prevent the second contact portion 61 from being removed from the contact arranging portion 31.

Figure 21:
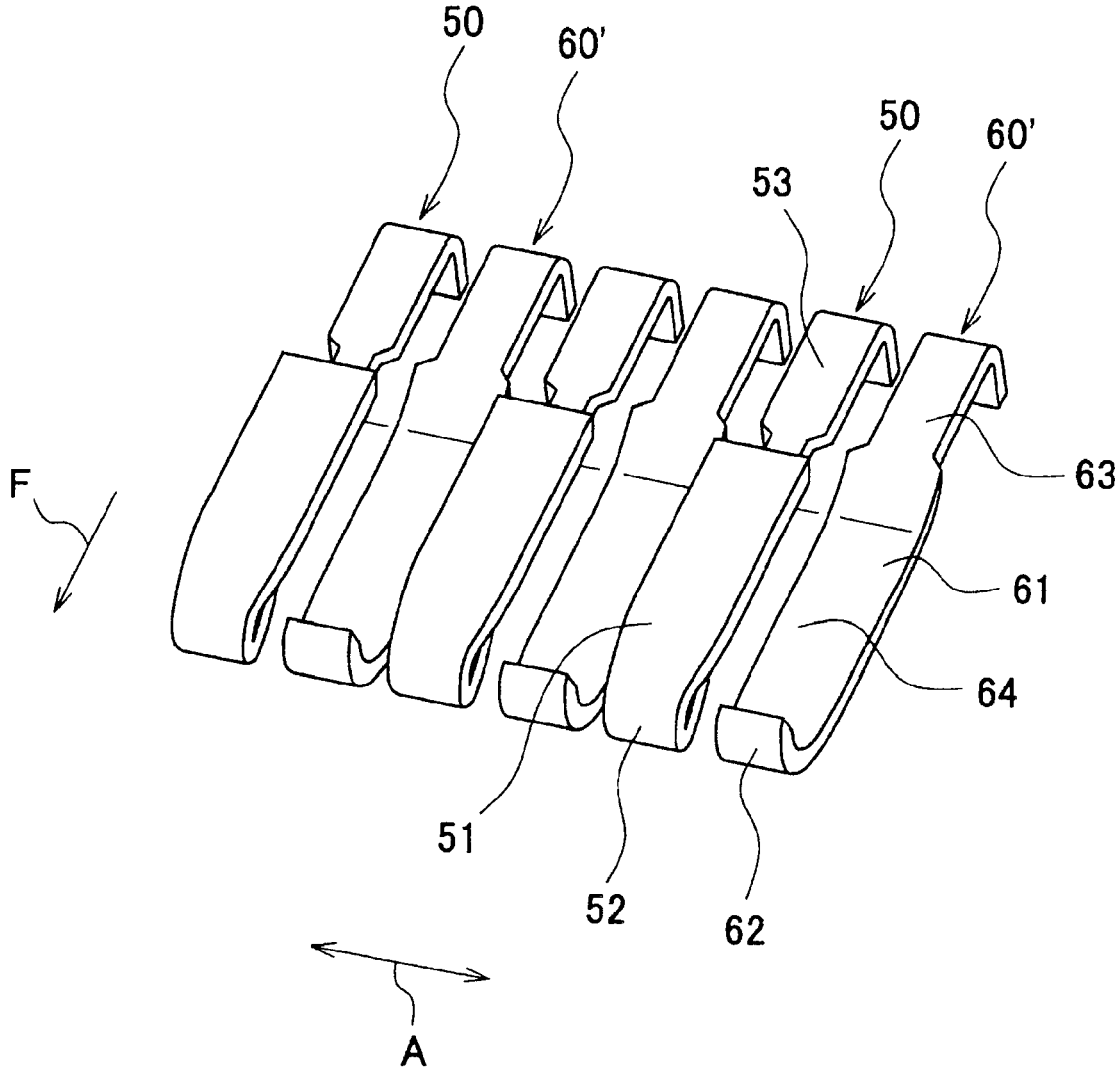
FIG. 21 is a perspective view of a variation of the first and second contacts as viewed obliquely from above.

It should be noted that although in the above-described embodiment, each second contact 60 is formed with the extension portion 64, each second contact 60' may not be formed with the extension portion 64 as in a variation of the second contact 60 shown in FIG. 21.

Further, although the width of the first contact portion 51 in the contact arrangement direction A is made equal to that of the second contact portion 61 in the contact arrangement direction A, they may not be equal to each other.

It should be noted that although the width of the linkage portion 54 in the contact arrangement direction A is made equal to that of the extension portion 64 in the contact arrangement direction A, they may not be equal to each other.

Further, although the width of the first bending portion 52 in the contact arrangement direction A is gradually reduced from the first contact portion 51 toward the linkage portion 54, with the width of one end of the first bending portion 52 in the contact arrangement direction A being made equal to the first contact portion 51, and the width of the other end of the first bending portion 52 in the contact arrangement direction A being made equal to the linkage portion 54, and the width of the second bending portion 62 in the contact arrangement direction A is gradually reduced from the second contact portion 61 toward the extension portion 64, with the width of one end of the second bending portion 62 in the contact arrangement direction A being made equal to the second contact portion 61, and the width of the other end of the second bending portion 62 in the contact arrangement direction A being made equal to the extension portion 64, it is not necessarily required to configure these widths in the above-described manner.

It is further understood by those skilled in the art that the foregoing are the preferred embodiments of the present invention, and that various changes and modification may be made thereto without departing from the spirit and scope thereof.

What is claimed is:

1. A connector comprising:

a housing that includes a contact arranging portion which is plate-shaped; and first and second contacts that are arranged on said housing in an alternating manner along a contact arrangement direction which is orthogonal to a direction of fitting said housing to a mating connector, said first contacts each having a first contact portion which is disposed on one surface of said contact arranging portion, a first bending portion which is continuous with said first contact portion, and is disposed on a front portion of said contact arranging portion, a first connecting portion which is disposed on a rear portion of said contact arranging portion, and is connected to an object to be connected, and a linkage portion which is disposed on the other surface of said contact arranging portion, and connects between said first bending portion and said first connecting portion, said second contacts each having a second connecting portion which is connected to the object to be connected, a second contact portion which is continuous with said second connecting portion, and is disposed on the other surface of said contact arranging portion, and a second bending portion which is continuous with said second contact portion, and is disposed on said front portion of said contact arranging portion, wherein said linkage portion is smaller in width in the contact arrangement direction than said first contact portion and said second contact portion.

2. The connector as claimed in claim 1, wherein said second contacts each have an extension portion which is continuous with said second bending portion, and is disposed on the one surface of said contact arranging portion, and wherein said extension portion is smaller in width in the contact arrangement direction than said first contact portion and said second contact portion.

3. The connector as claimed in claim 1, wherein a width of said first contact portion in the contact arrangement direction is equal to a width of said second contact portion in the contact arrangement direction.

4. The connector as claimed in claim 2, wherein a width of said first contact portion in the contact arrangement direction is equal to a width of said second contact portion in the contact arrangement direction.

5. The connector as claimed in claim 4, wherein a width of said linkage portion in the contact arrangement direction is equal to a width of said extension portion in the contact arrangement direction.

6. The connector as claimed in claim 2, wherein a width of said first bending portion in the contact arrangement direction is gradually reduced from said first contact portion toward said linkage portion, with a width of one end of said first bending portion in the contact arrangement direction being equal to a width of said first contact portion, and a width of the other end of said first bending portion in the contact arrangement direction being equal to a width of said linkage portion, and wherein a width of said second bending portion in the contact arrangement direction is gradually reduced from said second contact portion toward said extension portion, with a width of one end of said second bending portion in the contact arrangement direction being equal to a width of said second contact portion, and a width of the other end of said second bending portion in the contact arrangement direction being equal to a width of said extension portion.

7. The connector as claimed in claim 3, wherein a width of said first bending portion in the contact arrangement direction is gradually reduced from said first contact portion toward said linkage portion, with a width of one end of said first bending portion in the contact arrangement direction being equal to the width of said first contact portion, and a width of the other end of said first bending portion in the contact arrangement direction being equal to a width of said linkage portion, and wherein a width of said second bending portion in the contact arrangement direction is gradually reduced from said second contact portion toward said extension portion, with a width of one end of said second bending portion in the contact arrangement direction being equal to the width of said second contact portion, and a width of the other end of said second bending portion in the contact arrangement direction being equal to a width of said extension portion.

8. The connector as claimed in claim 4, wherein a width of said first bending portion in the contact arrangement direction is gradually reduced from said first contact portion toward said linkage portion, with a width of one end of said first bending portion in the contact arrangement direction being equal to the width of said first contact portion, and a width of the other end of said first bending portion in the contact arrangement direction being equal to a width of said linkage portion, and wherein a width of said second bending portion in the contact arrangement direction is gradually reduced from said second contact portion toward said extension portion, with a width of one end of said second bending portion in the contact arrangement direction being equal to the width of said second contact portion, and a width of the other end of said second bending portion in the contact arrangement direction being equal to a width of said extension portion.

9. The connector as claimed in claim 5, wherein a width of said first bending portion in the contact arrangement direction is gradually reduced from said first contact portion toward said linkage portion, with a width of one end of said first bending portion in the contact arrangement direction being equal to the width of said first contact portion, and a width of the other end of said first bending portion in the contact arrangement direction being equal to the width of said linkage portion, and wherein a width of said second bending portion in the contact arrangement direction is gradually reduced from said second contact portion toward said extension portion, with a width of one end of said second bending portion in the contact arrangement direction being equal to the width of said second contact portion, and a width of the other end of said second bending portion in the contact arrangement direction being equal to the width of said extension portion.

* * * * *